United States Patent [19]

Twellmann

[11] Patent Number: 4,609,236

[45] Date of Patent: Sep. 2, 1986

[54] DRAWER FOR CUPBOARDS

[75] Inventor: Guenter Twellmann, Spenge, Fed. Rep. of Germany

[73] Assignee: Ninkaplast GmbH, Fed. Rep. of Germany

[21] Appl. No.: 596,306

[22] Filed: Apr. 3, 1984

[30] Foreign Application Priority Data

Jun. 8, 1983 [DE] Fed. Rep. of Germany ... 8316770[U]

[51] Int. Cl.[4] ..... A47B 67/04

[52] U.S. Cl. ..... 312/330 R

[58] Field of Search ..... 312/330 R, 330 SM, 319, 312/257 A, 333

[56] References Cited

U.S. PATENT DOCUMENTS

| | | | |
|---|---|---|---|
| 3,251,363 | 5/1966 | Lundgren | 312/330 R |
| 4,403,817 | 9/1983 | Aidar | 312/330 R |
| 4,438,993 | 3/1984 | Rabas | 312/257 A |
| 4,458,965 | 7/1984 | Ohlendorf et al. | 312/330 R |

FOREIGN PATENT DOCUMENTS

| | | | |
|---|---|---|---|
| G8217277 | 9/1982 | Fed. Rep. of Germany . | |
| 2312215 | 12/1976 | Switzerland | 312/330 |

*Primary Examiner*—Francis K. Zugel
*Assistant Examiner*—Joseph Falk
*Attorney, Agent, or Firm*—Schwartz, Jeffery, Schwaab, Mack, Blumenthal & Evans

[57] ABSTRACT

A drawer for cupboards comprises a baseplate (10) guided displaceably in lateral guide rails, a frame (14) surrounding the baseplate at its lateral and rear edges, and an adjustable front plate (12) closing the drawer off at the front. Simple adjustment of the front plate (12), without prior dismantling of individual parts, becomes possible because the frame (14) is designed as a self-supporting part to be fastened to the baseplate (10), and because devices (30, 32) for the adjustable fastening of the front plate are provided at the ends of the frame (14) which face the front plate. This ensures, at the same time, that the frame, including the fastening and adjusting devices for the front plate forms together with the remaining parts (10, 12) of the drawer a smooth-surface structure.

9 Claims, 10 Drawing Figures

DRAWER FOR CUPBOARDS

BACKGROUND OF THE INVENTION

The invention relates to a drawer for cupboards, particularly a drawer for pots, with a baseplate guided displaceably in lateral guide rails, with a frame projecting vertically upwards and surrounding the baseplate at the lateral and rear edges, and with two supports projecting upwards from the baseplate on the open side of the frame for the adjustable fastening of a front plate.

Such drawers or pull-out compartments for pots are known in various embodiments. The frame, which limits the receiving surface for pots and pans and supplies, etc., on both sides and at the rear, usually consists of wire. The drawer as a whole is guided on drawer rails which comprise two lateral guide rails fixed to the cupboard, two carrier rails assigned to these and fastened to the baseplate, and a number of rollers. The carrier rails fastened to the baseplate usually have, in the region of the front plate, an upward-projecting extension, in which, on the one hand, the frame made of wire is suspended or inserted and which, on the other hand, carries a control mechanism for adjusting the front plate.

The lateral carrier rails, their extension for receiving the front plate and the frame made of wire are freely accessible in conventional drawers, so that it is not possible to prevent the danger of injury in view of the existing corners, edges and angles. Cleaning is extremely difficult. Moreover, the metal construction, which is visible at least when the drawer is opened, runs counter to present-day ideas of a modern smooth-surface kitchen design.

It is therefore also already known to cover the entire arrangement consisting of the carrier rails, frame and front-plate mounting with an attachable plastic sheathing. However, the disadvantage of this is that the plastic sheathing has to be removed in order to adjust the front plate, since the appropriate adjusting mechanisms are located on the front upward-projecting extensions of the lateral carrier rails of the baseplate.

SUMMARY OF THE INVENTION

The object on which the invention is based is, therefore, to provide a drawer for pots, of the generic type, which on the one hand presents a generally smooth-surface structure, but on the other hand allows the front plate to be easily adjusted, without prior dismantling of individual parts or removal of pots, etc., located in the drawer.

In a drawer for pots, of the generic type, this object is achieved, when the frame is designed as a self-supporting part to be fastened to the baseplate and, at its end facing the front plate, forms the supports for fastening the front plate.

It is therefore possible to do away completely with the hitherto conventional wire frame. This is also true of the front upward-projecting extensions of the lateral carrier rails, to which the front plate was fastened in known structures. The frame is a self-supporting part which, on the one hand, performs the function of the hitherto conventional wire frame, then covers the lateral guide rails completely, and finally allows the front plate to be fastened directly and adjustably.

Two essentially vertical one-part or multiple-part fastening strips are preferably attached to the inner face of the front plate, and the frame has a hollow structure which engages round the fastening strips and which carries on the inside the connecting devices for connection to the fastening strips. The frame is, in particular, a plastic injection-molding.

The fastening strips to be attached to the inner face of the front plate preferably have a plate-shaped projection which penetrates into the interior of the hollow frame structure and which can be clamped there adjustably. In this way, it is possible to achieve vertical adjustment of the front plate, and this can be assisted, if appropriate, by an eccentric connection between the frame and the fastening strips.

For the lateral adjustment of the front plate, the fastening strips engage so as to be displaceable in a lateral direction, preferably in the region of their lower end, via a play-free guide with sliding pieces which can be clamped, in a similar way to the projections, in the hollow frame structure at the upper ends of the fastening strips so as to be vertically adjustable and tiltable. The guides preferably comprise an anchor which engages into a groove and which can be spread apart to lock the fastening strips by means of a screw accessible through a wall of the frame, and can be clamped in the groove.

It has been shown that it is not necessary, as regards the lateral adjustment effected by the mechanism described above, to provide in the upper region of the frame a lateral play between the front plate and the frame. On the contrary, it is not disturbing from a visual point of view if the frame is carried along in its upper region during the lateral adjustment of the front plate, since the adjustment distances are in any case only short and a slight deviation of the frame from the vertical position is not perceived by the eye.

BRIEF DESCRIPTION OF THE DRAWINGS

A preferred exemplary embodiment of the invention is explained in more detail below with reference to the drawings.

DETAILED DESCRIPTION OF THE PREFERRED EMBODIMENTS

Figure 1:
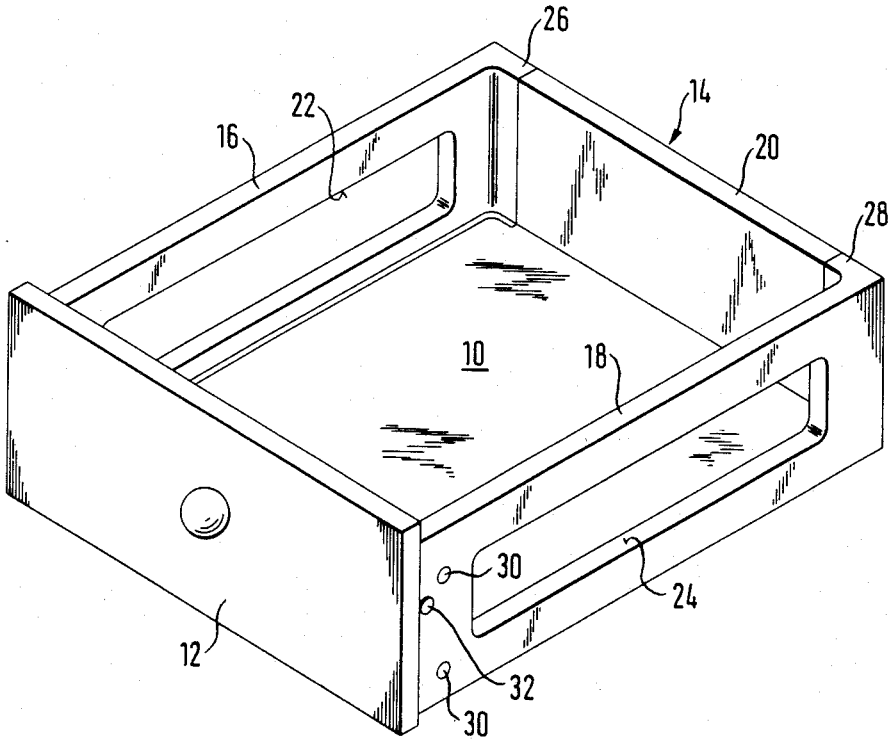
FIG. 1 is a general perspective representation of a drawer, according to the invention, for pots.

A drawer, according to the invention, for pots comprises a baseplate 10, a front plate 12 and a frame 14 comprising side walls 16, 18 and a rear wall 20. The drawer for pots is guided in guide rails, not shown here, at the lower edge of the side walls 16, 18.

In the example illustrated, the side walls 16, 18 of the frame 14 are designed as rectangular frames with elongate central orifices 22, 24. They are plastic injection moldings which are hollow on the inside and which are open on the side of the front plate 12 in a way not shown. The rear wall 20 designed, for example, as a chipboard is inserted into angled open ends 26, 28 of the side walls. The frame 14 is fastened to the baseplate 10. The front plate 12 is fastened to the side walls 16, 18 by means of fastening strips which will be explained in more detail later. The fastening strips can be clamped by means of clamping screws 30 between the layers of material of the hollow side walls. The clamping screws 30 accessible from inside are slackened a little for the purpose of vertical adjustment and tilting of the front plate 12. In the example shown, the vertical adjustment of the front plate is assisted by an eccentric 32.

Figure 2:
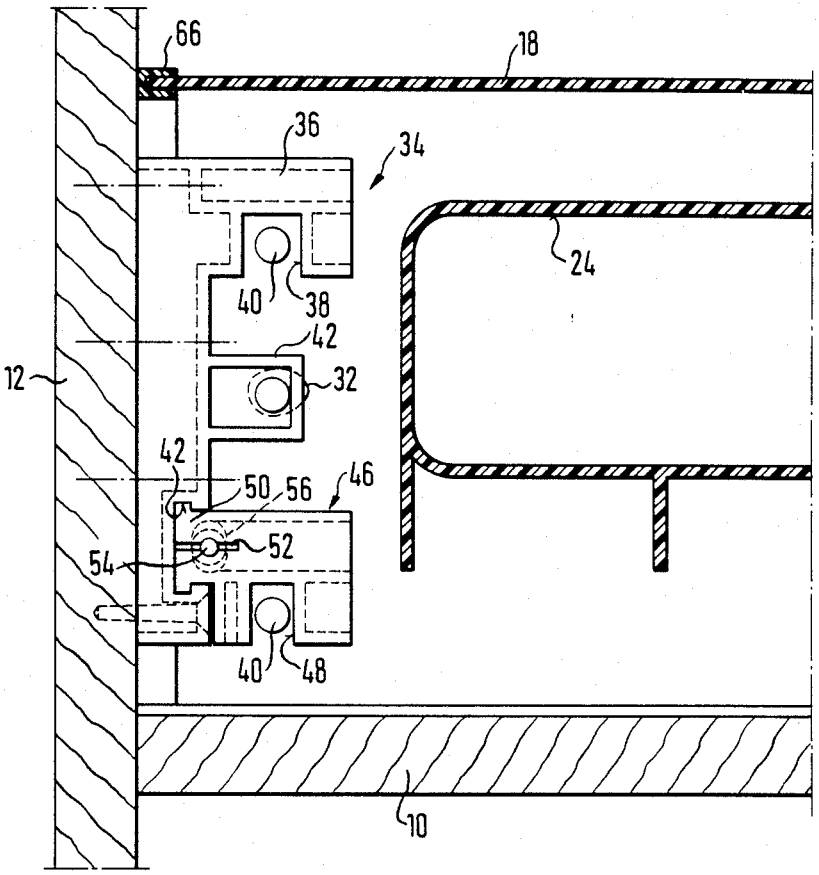
FIG. 2 is a diagrammatic and partially cut-away side view of the fastening device for the front plate.

FIG. 2 shows one of the fastening strips 34 which is screwed onto the inner face of the front plate 12 and which projects into the open end of the hollow side wall 18. The fastening strip 34 has at its upper end a hook-shaped projection 36 which forms a recess 38 open at the bottom. A threaded sleeve 40 for the clamping screw 30 extends through the recess 38 at a distance.

An extention 42 for the eccentric 32 is provided in the central region of the clamping strip 34.

In the region of the lower end, the fastening strip 34 is provided with an undercut transverse groove 44 which, in the example illustrated, has a T-shaped profile.

A sliding piece 46 corresponds in its shape essentially to the projection 36 of the fastening strip, but has a narrower recess 48 which receives the threaded sleeve 40 for the lower clamping screw with relatively little play. At the front end, the sliding piece 46 has an anchor 50 which eengages with the groove 44 of the fastening strip 34 and which is divided into two halves by a horizontal slit 52. In the plane of the slit 52, there is provided in the anchor a transverse conical bore, into which a locking screw 54 for spreading apart the two halves of the anchor can be screwed. The locking screw 54 is accessible through a slot 56 in the inner layer of material of the side wall 18.

Figure 3:
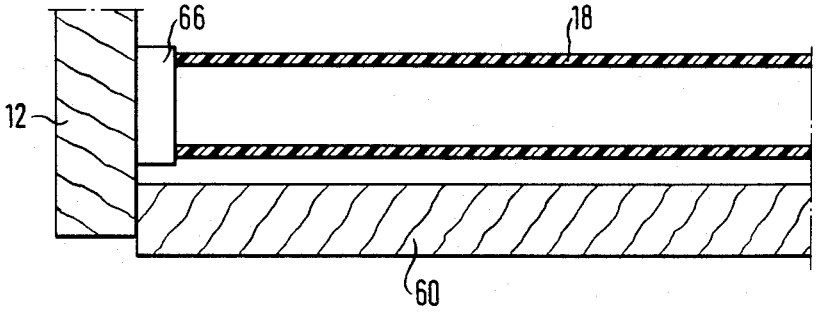
FIG. 3 is a partially cut-away plan view of the region of connection between the front plate and a side wall of the frame.
Figure 4:
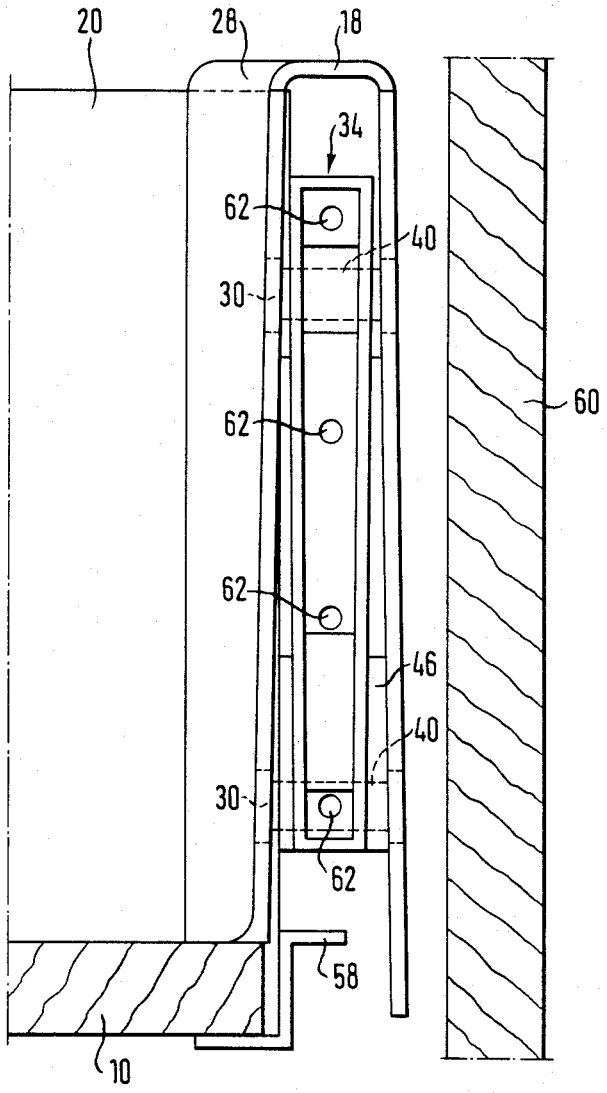
FIG. 4 is a front view of the side wall of the frame, with the front plate removed.

As can be seen in FIGS. 3 and 4, the side wall 18 has essentially the same width over its entire length. According to FIG. 4, the side wall is widened slightly towards the bottom, and the outer layer of material engages over a carrier rail 58 which is fastened to the baseplate 10 and which, when the drawer for pots is pulled out, interacts with a guide rail (not shown) on a carcase wall 60 of the cupboard.

The fastening strip 34 is clamped in the upper region between the layers of material of the side wall 18 by means of the threaded sleeve 40 and the clamping screw 30 and tapers towards the bottom, so that the sliding piece 46 projects above it on both sides at the bottom end. The sliding piece 46 is clamped firmly between the layers of material of the side wall 18 by means of the lower threaded sleeve and the clamping screw.

The fastening strips 34 and the sliding pieces 46 are, for example, hollowed-out injection moldings. The fastening strip 34 is provided with screw-holes 62 or pegs for fastening to the front plate 12 and has on its lateral surfaces a ribbing 64 at least in the region of the projection 36. A corresponding ribbing is provided on the corresponding surfaces of the side walls 16, 18.

Figure 10:
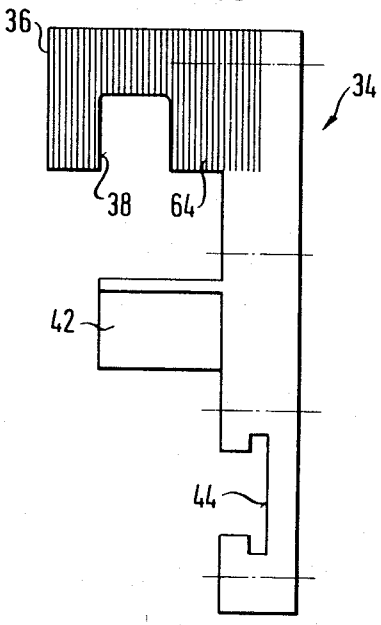
FIGS. 9 and 10 show respectively a further front view and side view of the fastening strip.
Figure 9:
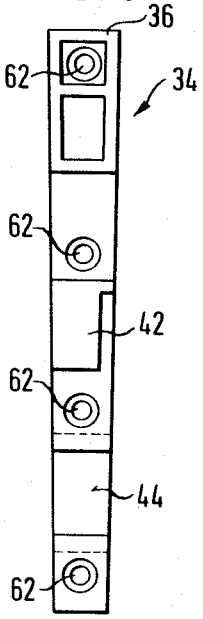
Figure 6:
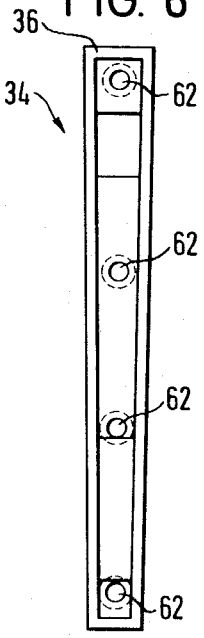
FIGS. 5 and 6 are side and front views of a fastening strip.
Figure 8:
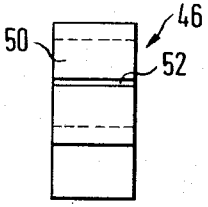
FIGS. 7 and 8 are corresponding views of a sliding piece.
Figure 5:
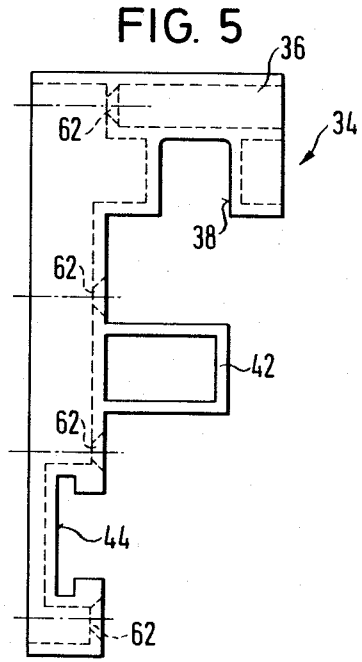
Figure 7:
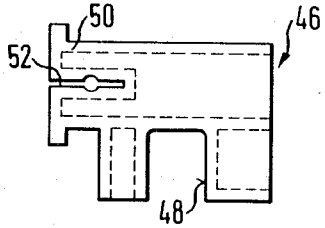

Whilst a vertical ribbing is illustrated in FIG. 10, it is also possible to provide a horizontal ribbing or a roughening which guarantees firm engagement between the fastening strips 34 and the side walls 16, 18 both in the pull-out direction and in terms of height. Horizontal ribbing is to be preferred particularly when no eccentric or a comparable mechanism for vertical adjustment is provided.

When the front plate 12 is assembled, the screwedon fastening strips 34 are introduced into the open ends of the side walls 16, 18 and lowered so that the threaded sleeves 40 penetrate into the recesses 48, 38 and the extension 42 comes up against the eccentric 32 at a preset normal height. The height of the front plate 12 can be adjusted subsequently by rotating the eccentric. To set the normal height, another device, for example a springloaded engagement device, can be provided instead of an eccentric.

To set the desired inclination of the front plate, the front plate 12 together with the fastening strip 34 and the sliding piece 46 can be tilted about the axis formed by the front edge of the bottom 10. A gap which may arise as a result between the front plate 12 and the side walls 16, 18 can be closed by means of a connecting gasket 66.

To lock the front plate at the desired height and inclination, the clamping screws 30 are tightened, so that the extensions 36 and the sliding pieces 46 are clamped firmly between the layers of material of the side walls 16, 18.

For the lateral adjustment of the front plate 12, the latter can be displaced sideways together with the fastening strip 34. The free upper ends of the side walls are carried along, with the side walls being bent slightly. On the other hand, the lower edges, secured on the baseplate 10, of the side walls and the clamped sliding pieces 46 do not change their position, since the fastening strips 34 are displaceable in a lateral direction on the anchors 50. Because the fastening strips 34 taper towards the bottom, whereas the side walls 16, 18 widen towards the bottom, sufficient latitude of movement for lateral displacement of the lower ends of the fastening strips is guaranteed. When the anchors 50 are subsequently spread apart by means of the locking screws 54 and clamped in the grooves 44, the front plate 12 is also locked in a lateral direction.

According to the invention, the anchors 50 and the grooves 44 form a play-free guide which allows the front plate to be adjusted laterally in a simple and accurate manner.

A particular advantage of the adjusting and fastening devices according to the invention is that, because they are compact, these devices can be accommodated in the relatively narrow side walls. As can be seen, moreover, in FIG. 4, the entire guide mechanism of the drawer is at the same time essentially covered laterally by the side walls which have a profile open towards the bottom in the form of a U.

The play of the threaded sleeves 40 in the recesses 38 and 48 is calculated in such a way that when the front plate 12 is tilted the tilting axis is formed by the front edge of the bottom 10. The advantage of this is that the front plate 12 can always be brought up against the bottom, so that no gap remains between the bottom and the front plate of the drawer for pots.

In the above description, the invention was explained with reference to the example of a drawer for pots. However, the invention can be used for cupboard drawers in general. Furthermore, modifications of the devices accommodated in the side walls and intended for the adjustable fastening of the front plate are also possible within the scope of the invention. For example, the fastening strips and/or the sliding pieces can also be clamped by means of one or more intermediate plates attached in the side walls parallel to the wall layers. According to choice, during the lateral adjustment of the front plate, the fastening strips can also interact with guides connected firmly to the baseplate of the drawer.

I claim:

1. A drawer for cupboards, particularly a drawer for pots, comprising:

a baseplate having lateral and rear edges;

a front plate having an inner face and two sides;

a frame projecting vertically upwards and surrounding the baseplate at the lateral and rear edges, said frame being a self supporting part to be fastened to the baseplate and having an open side and two ends facing the front plate on the open side of the frame, said ends forming supports for the adjustable fastening of said front plate;

at each side of said front plate, an essentially vertical fastening strip attached to the inner face of the front plate, the frame having a hollow structure which engages the fastening strip, the fastening strip having a projection which is received in the hollow structure and which includes a recess which is open at the bottom and which surrounds at a distance a clamping screw extending transversely through the hollow structure to clamp the hollow structure to said fastening strip and to allow vertical and tilting adjustment of the front plate in relation to the base plate, a sliding piece clamped in the hollow structure in the end of the frame which faces the front plate, and wherein the fastening strip slidably engages the sliding piece in the lower region of the frame, via a play-free guide extending transversely to the pull-out direction of the drawer; and means for locking the fastening strip on the sliding piece.

2. A drawer as claimed in claim 1, including carrier rails mounted to said baseplate, wherein the frame extends over the carrier rails to cover the carrier rails.

3. A drawer as claimed in claim 1, wherein the contact surfaces between the projection and the corresponding inner faces of the hollow structure are formed with a friction increasing surface.

4. A drawer as claimed in claim 1, wherein there is an eccentric which is mounted rotatably in the wall of the frame and which engages an extension of the fastening strip to produce vertical adjustment.

5. A drawer as claimed in claim 1, wherein the frame has a double-layer side wall forming the hollow structure, the projection of the fastening strip and the sliding piece can respectively be clamped directly between the two wall layers of the side walls, the width of the fastening strip is less in the lower region than the width of the sliding pieces, and the sliding piece has a recess which is open at the bottom and which receives at a distance a further clamping screw extending transversely through the slide wall.

6. A drawer as claimed in claim 1, wherein undercut grooves are provided in the fastening strip and an anchor which can be spread apart is provided on the sliding piece in order to guide and lock the fastening strip on the sliding piece.

7. A drawer as claimed in claim 1 wherein there is a connecting gasket which can be pushed onto the open end of the side wall and which is intended for sealing off a gap between the side wall of the frame and the front plate.

8. A drawer as claimed in claim 3, wherein there is an eccentric which is mounted rotatably in the wall of the frame and which engages an extension of the fastening strip to produce vertical adjustment.

9. A drawer as claimed in claim 5, wherein undercut grooves are provided in the fastening strip and an anchor which can be spread apart is provided on the sliding piece in order to guide and lock the fastening strip on the sliding piece.

* * * * *